US006289617B1

(12) United States Patent
Snyder

(10) Patent No.: US 6,289,617 B1
(45) Date of Patent: Sep. 18, 2001

(54) ADDRESS PLATE FOR STEPPED WALL STRUCTURES

(76) Inventor: Ralph N. Snyder, 323 Plaza Rd. N., Fair Lawn, NJ (US) 07410

( * ) Notice: Subject to any disclaimer, the term of this patent is extended or adjusted under 35 U.S.C. 154(b) by 0 days.

(21) Appl. No.: 09/634,348

(22) Filed: Aug. 8, 2000

(51) Int. Cl.[7] ..... G09F 7/00

(52) U.S. Cl. ..... 40/584; 40/631; 52/105; 248/205.1; 248/224.51

(58) Field of Search ..... 40/584, 625, 631, 40/542; 52/58, 103, 105; 248/205.1, 224.51, 229.2, 229.21, 226.11

(56) References Cited

U.S. PATENT DOCUMENTS

| | | | | |
|---|---|---|---|---|
| D. 361,093 | | 8/1995 | Pitts . | |
| 1,781,445 | | 11/1930 | Denison . | |
| 2,205,515 | * | 6/1940 | Burroway | 40/584 |
| 2,584,699 | | 2/1952 | Hansen . | |
| 4,229,916 | | 10/1980 | White . | |
| 4,314,429 | * | 2/1982 | Casteel et al. | 52/105 X |
| 4,887,195 | * | 12/1989 | Donelan | 40/574 X |
| 5,267,404 | * | 12/1993 | Kizy | 40/545 |
| 5,275,366 | | 1/1994 | Simmons . | |
| 5,549,266 | * | 8/1996 | Mitchell et al. | 248/205.1 |
| 5,775,032 | | 7/1998 | Lacy . | |
| 6,061,940 | * | 5/2000 | Rice | 40/594 |

* cited by examiner

*Primary Examiner*—Brian K. Green
*Assistant Examiner*—James M Hewitt
(74) *Attorney, Agent, or Firm*—Arthur Jacob

(57) ABSTRACT

An address plate is fitted over a building wall having a stepped profile configuration established by overlapped courses of shingles or clapboards. The address plate includes a generally flat display panel for displaying indicia pertaining to the address of the building and tongues inserted between the overlapped courses to hold the display panel in juxtaposition with a selected course. Tabs are placed at steps between the overlapped courses for fasteners which secure the address plate in place.

11 Claims, 3 Drawing Sheets

ADDRESS PLATE FOR STEPPED WALL STRUCTURES

The present invention relates generally to the display of information upon the wall of a building and pertains, more specifically, to an address plate constructed for ready placement on and securement to a wall having a stepped profile configuration, such as a shingled or overlapped clapboard structure, for displaying information pertaining to the building and, in particular, information identifying the address of the building.

A very large number of buildings, and especially residential buildings, employ wall structures which utilize overlapped shingles or clapboards establishing a stepped profile configuration along the wall. The placement of identifying indicia, such as an address, on these stepped profile walls often eludes simple installation and an aesthetically pleasing appearance. The present invention provides an address plate constructed especially for placement on such a stepped profile wall and securement to the wall with ease and economy. As such, the present invention attains several objects and advantages, some of which are summarized as follows: Provides an address plate especially constructed for fitting to a stepped profile wall structure with ease and economy; attains a simple and aesthetically pleasing installation which displays identifying information, such as an address, upon a building wall having a stepped profile configuration; allows increased versatility in the placement of an address upon a building having a wall constructed of overlapped elements, such as; shingles or clapboards, presenting a stepped profile configuration; assures a secure installation with minimum expense and a simple installation procedure; requires no modification of the wall structure for effective installation and leaves little indication of having been installed should removal become necessary; enables versatility in aesthetic design and appearance for accommodating a wide variety of building styles and architecture; provides a rugged address plate capable of exemplary performance over an extended service life.

The above objects and advantages, as well as further objects and advantages, are attained by the present invention which may be described briefly as an address plate for providing a visual display on a wall having a stepped profile configuration established by overlapped courses including an upper course, a lower course, an intermediate course between the upper and lower courses, an upper step extending generally outwardly in a first direction from the intermediate course toward the upper course, and a lower step extending generally inwardly in a second direction from the intermediate course toward the lower course, the intermediate course having a given longitudinal extent between the upper course and the lower course such that the lower step is spaced a corresponding first longitudinal distance from the upper step, the address plate comprising: a display panel having an upper boundary, a lower boundary spaced longitudinally from the upper boundary, and laterally opposite side edges; a display face on the display panel for bearing the visual display; at least one upper tongue projecting from the upper boundary for extending in an upward direction; an upper tab projecting from the upper boundary for extending transverse to the display panel in the first direction; a lower tab projecting from the lower boundary for extending transverse to the display panel in the second direction; the lower tab being spaced from the upper tab a second longitudinal distance corresponding to the first longitudinal distance such that upon insertion of the upper tongue between the upper course and the intermediate course the display panel will be juxtaposed with the intermediate course, the upper tab will be juxtaposed with the upper step, and the lower tab will be juxtaposed with the lower step; whereby the display face will be placed between the upper and lower courses for presenting the visual display along the intermediate course.

The present invention will be understood more fully, while still further objects and advantages will become apparent, in the following detailed description of preferred embodiments of the invention illustrated in the accompanying drawing, in which.

Figure 1:
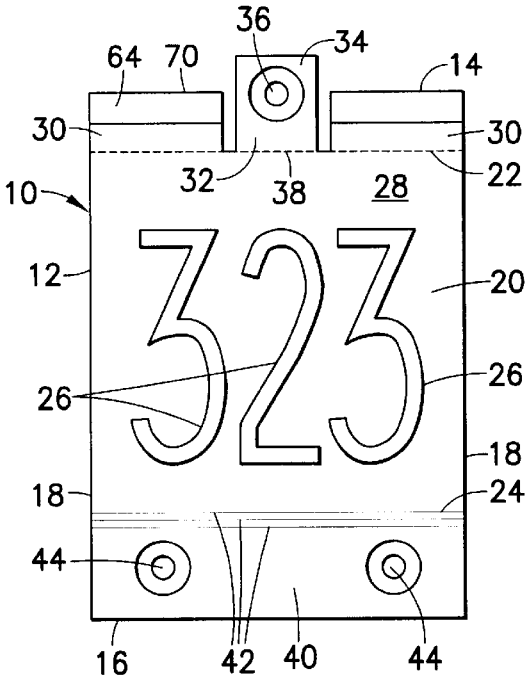
FIG. 1 is a plan view of an address plate constructed in accordance with the present invention.

Referring now to the drawing, and especially to FIG. 1 thereof, an address plate constructed in accordance with the present invention is shown at 10 and is seen to include a plate member 12 extending longitudinally between an upper edge 14 and a lower edge 16, and laterally between opposite side edges 18. A portion of the plate member 12 provides a display panel 20 having an upper boundary 22 and a lower boundary 24 spaced longitudinally from the upper boundary 22, the display panel 20 extending laterally between the opposite side edges 18. The display panel 20 carries identifying information pertaining to a building upon which the address plate 10 is to be mounted, in this instance the identifying information being illustrated in the form of indicia 26 representing the numerical address of the building. In the illustrated embodiment, indicia 26 are imprinted upon an essentially flat display face 28 on the display panel 20; however, the indicia 26 may be established by any suitable means for providing a visual display, including molding, embossing or debossing directly into the material of the plate member 12, or by affixing separate discrete numerals to the display panel 20. Display panel 20 itself is essentially flat and has an overall generally rectangular plan configuration.

A pair of upper tongues 30 project upwardly from upper boundary 22 and are spaced apart laterally at 32. An upper tab 34 is located between the upper tongues 30 and projects from the upper boundary 22. An aperture 36 in the upper tab 34 provides an element of a fastener, as will be described more fully hereinafter. In the present embodiment upper tab 34 is shown lying essentially in the same plane as display panel 20 and is separated from display panel 20 by a bend line 38, for purposes to be described below. A lower tab 40 projects from the lower boundary 24 of the display panel 20 and, in the preferred construction, several bend lines 42 are parallel to one another and extend laterally across the plate member 12, from one to the other of side edges 18, between the display panel 20 and the lower tab 40. Apertures 44 in lower tab 40 provide elements of further fasteners, as will be described below.

Figure 2:
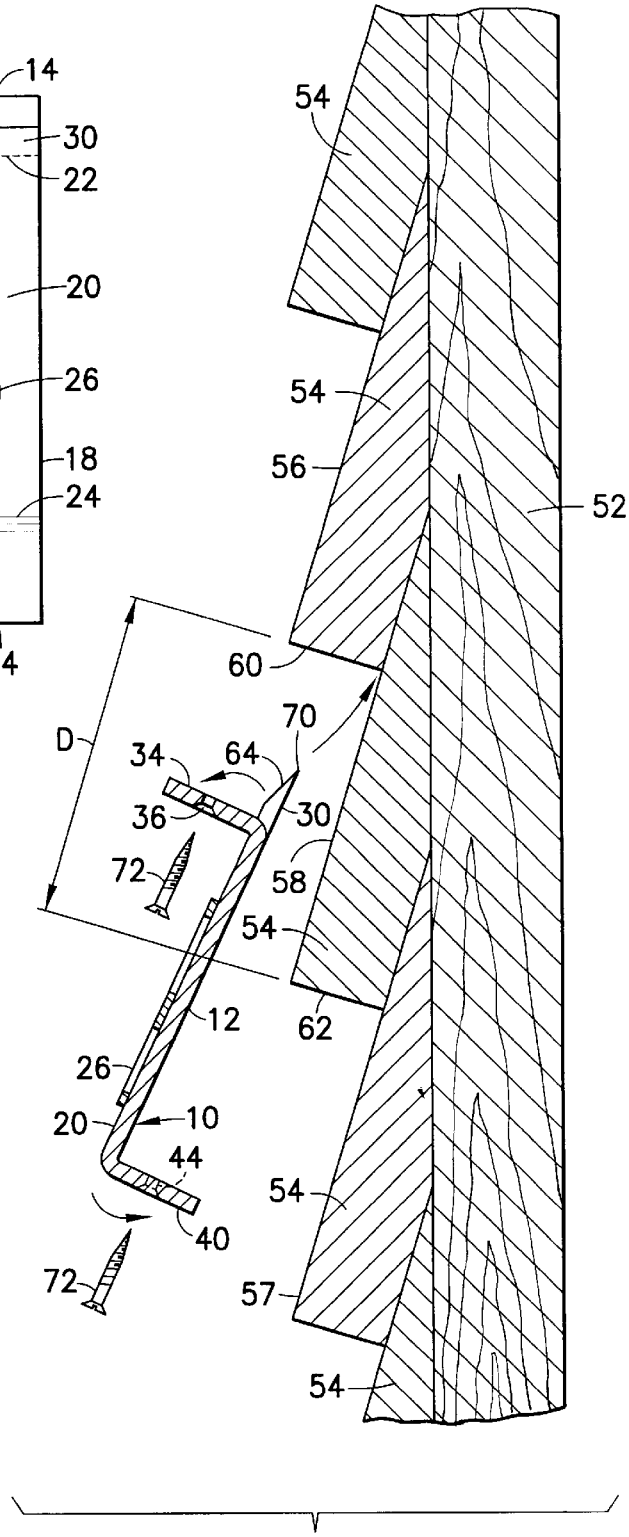
FIG. 2 is a longitudinal cross-sectional view showing the address plate as it is being installed on a building wall.
Figure 3:
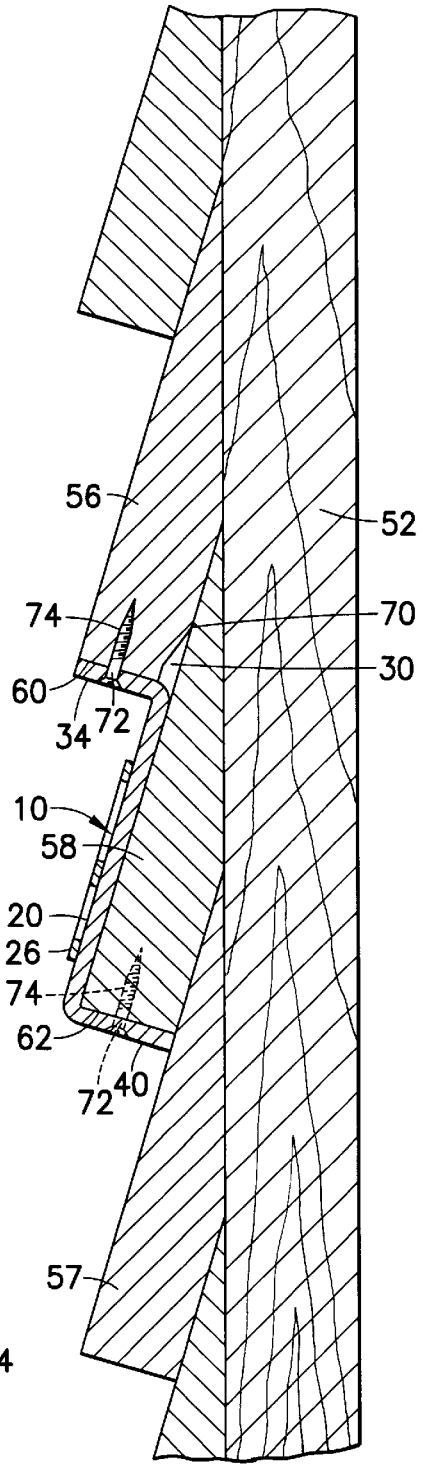
FIG. 3 is a longitudinal cross-sectional view similar to FIG. 2, with the address plate fully installed.

Turning now to FIGS. 2 and 3, address plate 10 is to be mounted upon a building 50 having a wall 52 with a stepped profile configuration established by overlapped clapboards 54 in a structure common to a wide variety of commercial and residential buildings. A portion of the overlapped clapboard structure is illustrated in the form of an upper course 56, a lower course 57 and an intermediate course 58 between the upper and lower courses 56 and 57, establishing an upper step 60, extending in a first direction generally outwardly from the intermediate course 58 toward the upper course 56, and a lower step 62 extending in a second direction generally inwardly from the intermediate course 58 toward the lower course 57, the upper step 60 and the lower step 62 being spaced apart by a longitudinal distance D corresponding to the longitudinal extent along the intermediate course 58 between the upper and lower courses 56 and 57. In order to effect installation of address plate 10 upon wall 52, upper tab 34 is made to project outwardly, in the first direction, to extend transverse to the display panel 20, as by bending along bend line 38, as shown, and upper tongues 30 are inserted between upper course 56 and intermediate course 58 until upper tab 34 is juxtaposed with, and preferably abuts upper step 60. Lower tab 40 is made to project inwardly, in the second direction, to extend transverse to the display panel 20 and opposite to the first direction, as by bending along a selected one of bend lines 42, so as to be juxtaposed with, and preferably abut lower step 62, with display panel 20 juxtaposed with, and preferably contiguous with intermediate course 58. Thus, address plate 10 is provided with a generally Z-shaped cross-sectional configuration which essentially follows the contour configuration of the intermediate course 58 and the upper and lower steps 60 and 62.

The availability of the plurality of bend lines 42 enables the selection of an appropriate bend line 42 for accommodating variations in the longitudinal distance D among building walls encountered in the field. Insertion of the upper tongues 30 preferably is facilitated by providing each upper tongue 30 with a wedge-shaped cross-sectional configuration 64 adjacent upper edge 70 of each upper tongue 30. Address plate 10 then is secured in place by further fastener elements shown in the form of a threaded fastener 72 advanced through aperture 36 in upper tab 34 into the upper course 56 at step 60, and threaded fasteners 72 advanced through apertures 44 in lower tab 40 into intermediate course 58 at step 62. Should it become necessary or desirable to remove address plate 10 from wall 52, threaded fasteners 72 merely are withdrawn from apertures 36 and 44, thereby releasing address plate 10 for removal. Any open holes 74 which remain in the upper and intermediate courses 56 and 58 as a result of the withdrawal of threaded fasteners 72 are essentially hidden from view by virtue of the location of such holes 74 at the upper and lower steps 60 and 62, providing little indication of the previous installation of address plate 10.

The preferred material for address plate 10 is a readily bendable corrosion-resistant metal such as aluminum, in which case the bend lines 38 and 42 are scored lines in the metal plate member 12. Address plate 10 also can be constructed of a synthetic polymeric material, such as polypropylene or PVC, with appropriately formed bend lines 38 and 42. Alternately, the address plate can be molded or otherwise formed with the tabs 34 and 40 already extending outwardly and inwardly, respectively, in a fully formed Z-shaped cross-sectional configuration. With any of these materials, address plate preferably is constructed in a unitary member supplied either in an essentially flat configuration, as illustrated in FIG. 1, for subsequent erection into the desired Z-shaped cross-sectional configuration when installed in the field, as described above, or in the full Z-shaped cross-sectional configuration, requiring no further erection in the field.

Figure 4:
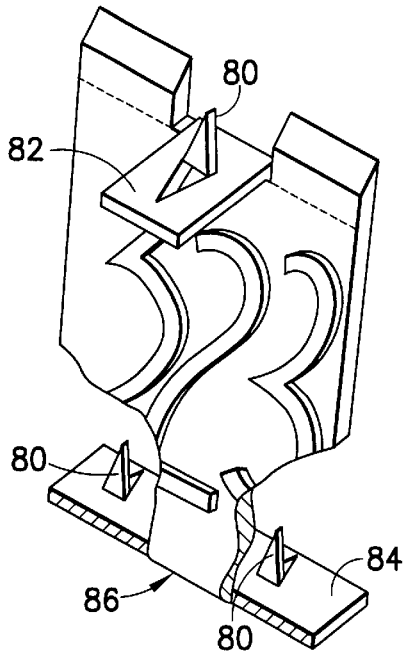
FIG. 4 is a pictorial perspective view, partially broken away, of an alternate address plate construction.

As an alternative to the fasteners shown provided by apertures 36 and 44 and threaded fasteners 72, fasteners can be provided by integral fastener elements such as pronged elements 80 formed unitary with upper and lower tabs 82 and 84, as shown in the alternate embodiment illustrated by address plate 86 of FIG. 4. The pronged elements 80 merely are driven into the upper and intermediate courses 56 and 58 during installation of the address plate.

Figure 5:
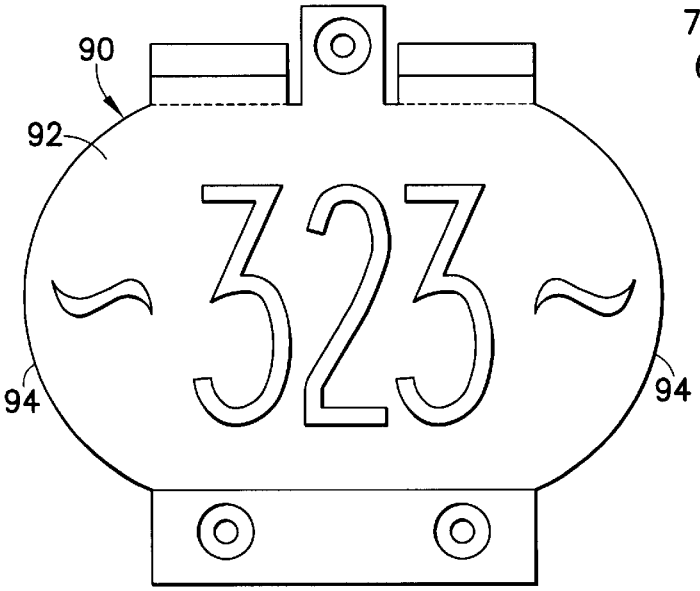
FIG. 5 is a plan view similar to FIG. 1 and showing another alternate embodiment of the present invention.

In the embodiment of FIG. 5, address plate 90 is provided with a display panel 92 having opposite side edges 94 which follow an arcuate contour for establishing an alternate plan configuration. Thus, while display panel 20 has straight side edges 18 and therefore is generally rectangular, display panel 92 follows a somewhat oval configuration. Other configurations appropriate to buildings having particular styles and architectural features will become apparent to those of ordinary skill in the art.

Figure 6:
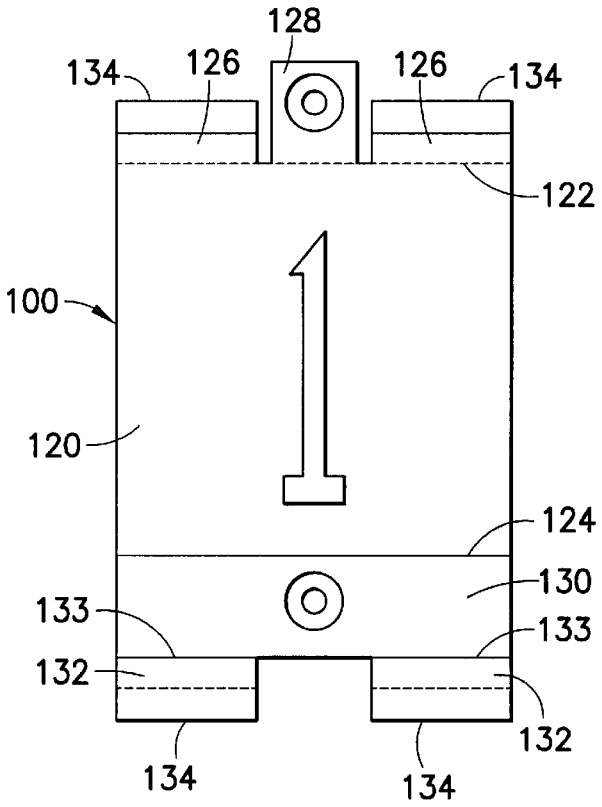
FIG. 6 is a plan view similar to FIG. 1 and showing a further alternate embodiment of the present invention.
Figure 7:
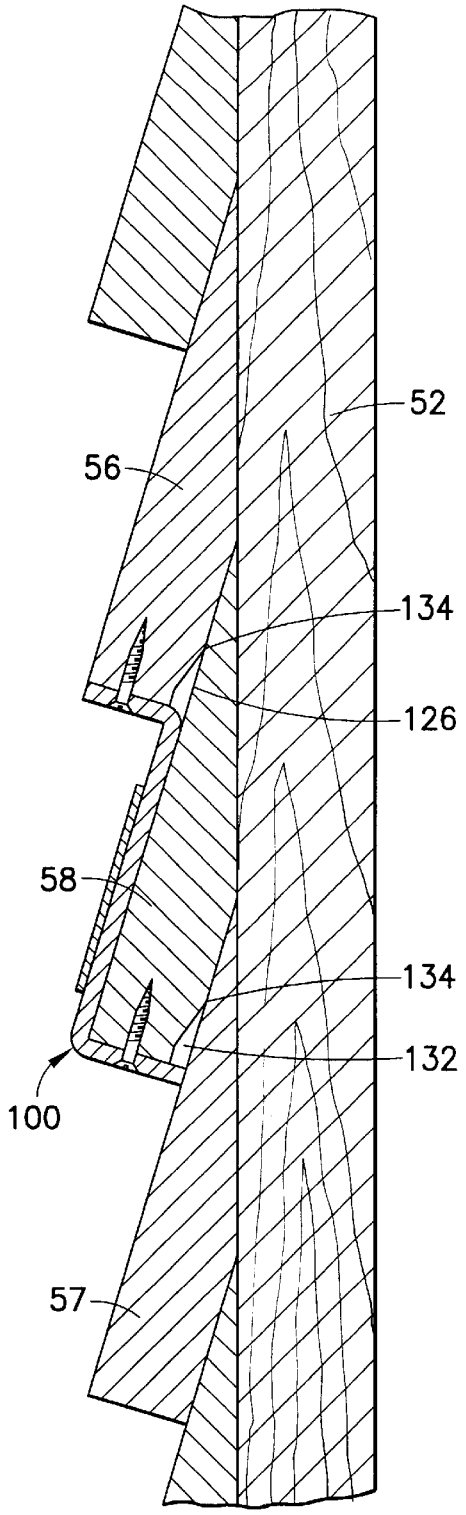
FIG. 7 is a longitudinal cross-sectional view similar to FIG. 3 and showing the embodiment of FIG. 6 fully installed.

Turning now to FIGS. 6 and 7, an address plate 100 is constructed in a manner similar to address plate 10 in that a display panel 120 includes upper and lower boundaries 122 and 124, respectively, with upper tongues 126 and an upper tab 128, and a lower tab 130. However, address plate 100 further includes lower tongues 132 which are made to project upwardly from lower tab 130, as seen in FIG. 7, as by bending along further fold lines 133, for insertion between overlapped intermediate and lower courses 58 and 57 of wall 52. The upper tongues 126 and the lower tongues 132 each are provided with wedge-shaped uppermost edges 134 to ease insertion between the respective overlapped courses 56, 57 and 58. The wedged insertion of the upper and lower tongues 126 and 132 enable securement of address plate 100 in place, fully installed, as shown in FIG. 7, without the necessity for further fasteners.

It will be seen that the present invention attains the several objects and advantages summarized above, namely: Provides an address plate especially constructed for fitting to a stepped profile wall structure with ease and economy; attains a simple and aesthetically pleasing installation which displays identifying information, such as an address, upon a building wall having a stepped profile configuration; allows increased versatility in the placement of an address upon a building having a wall constructed of overlapped elements, such as shingles or clapboards, presenting a stepped profile configuration; assures a secure installation with minimum expense and a simple installation procedure; requires no modification of the wall structure for effective installation and leaves little indication of having been installed should removal become necessary; enables versatility in aesthetic design and appearance for accommodating a wide variety of building styles and architecture; provides a rugged address plate capable of exemplary performance over an extended service life.

It is to be understood that the above detailed description of preferred embodiments of the invention are provided by way of example only. Various details of design and construction may be modified without departing from the true spirit and scope of the invention as set forth in the appended claims.

The embodiments of the invention in which an exclusive property or privilege is claimed are defined as follows:

1. An address plate for providing a display on a wall having a stepped profile configuration established by overlapped courses including an upper course, a lower course, an intermediate course between the upper and lower courses, an upper step extending generally outwardly in a direction from the intermediate course toward the upper course, and a lower step extending generally inwardly in a direction from the intermediate course toward the lower course, the intermediate course having a given longitudinal extent between the upper course and the lower course such that the lower step is spaced a corrresponding longitudinal distance from the upper step, the address plate comprising:

a display panel having an upper boundary, a lower boundary spaced longitudinally from the upper boundary, and laterally opposite side edges;

a display face on the display panel, the display face bearing a visual display;

at least one upper tongue projecting from the upper boundary and extending in an upward direction;

an upper tab projecting from the upper boundary and extending transverse to the display panel in a first transverse direction; and a lower tab projecting from the lower boundary and extending transverse to the display panel in a second transverse direction essentially opposite to the first transverse direction;

the lower tab being spaced from the upper tab a prescribed longitudinal distance such that upon insertion of the upper tongue between the upper course and the intermediate course the display panel will be juxtaposed with the intermediate course, the upper tab will be juxtaposed with the upper step, and the lower tab will be juxtaposed with the lower step;

whereby upon such juxtaposition of the display panel with the intermediate course, the display face will be placed between the upper and lower courses to present the visual display along the intermediate course.

2. The address plate of claim 1 including a fastener for securing one of the upper tab and the lower tab at a corresponding one of the upper step and the lower step.

3. The address plate of claim 2 wherein the fastener includes an aperture in the one tab and a fastener element for extending through the aperture and into a corresponding one of the upper course and the intermediate course.

4. The address plate of claim 3 wherein the fastener element is a threaded fastener.

5. The address plate of claim 1 including a first fastener for securing the upper tab at the upper step, and a second fastener for securing the lower tab at the lower step.

6. The address plate of claim 5 wherein the first fastener includes a first aperture in the upper tab and a first fastener element for extending through the first aperture and into the upper course, and the second fastener includes a second aperture in the lower tab and a second fastener element for extending through the second aperture and into the intermediate course.

7. The address plate of claim 5 wherein the first fastener includes a first pronged element integral with the upper tab, and the second fastener includes a second pronged element integral with the lower tab.

8. The address plate of claim 1 wherein the first transverse direction extends generally outwardly from the display panel, and the second transverse direction extends generally inwardly from the display panel, such that the address plate has a generally Z-shaped longitudinal cross-sectional configuration.

9. The address plate of claim 8 wherein the upper tongue, the upper tab and the lower tab are unitary with the display panel.

10. The address plate of claim 1 including a pair of upper tongues spaced apart laterally along the upper boundary, the upper tab being located laterally between the pair of upper tongues.

11. The address plate of claim 1 including at least one lower tongue projecting from the lower tab and extending in the upward direction for insertion between the intermediate course and the lower course when the display panel is juxtaposed with the intermediate course.

* * * * *